US011293201B2

(12) United States Patent
Weng

(10) Patent No.: US 11,293,201 B2
(45) Date of Patent: Apr. 5, 2022

(54) CHAIN LOCK

(71) Applicant: SINOX CO., LTD, New Taipei (TW)

(72) Inventor: Chia-Wei Weng, New Taipei (TW)

(73) Assignee: SINOX CO., LTD, New Taipei (TW)

( * ) Notice: Subject to any disclaimer, the term of this patent is extended or adjusted under 35 U.S.C. 154(b) by 391 days.

(21) Appl. No.: 16/664,562

(22) Filed: Oct. 25, 2019

(65) Prior Publication Data

US 2020/0131806 A1 Apr. 30, 2020

(30) Foreign Application Priority Data

Oct. 26, 2018 (TW) ..... 107214631

(51) Int. Cl.

| | |
|---|---|
| ***E05B 73/00*** | (2006.01) |
| ***E05B 67/00*** | (2006.01) |
| ***E05B 71/00*** | (2006.01) |
| ***E05B 67/36*** | (2006.01) |

(52) U.S. Cl.
CPC ..... *E05B 73/0005* (2013.01)

(58) Field of Classification Search
CPC .... E05B 73/0005; E05B 67/003; E05B 71/00; E05B 67/36
USPC ..... 70/14, 18, 30, 49, 53, 58, 233
See application file for complete search history.

(56) References Cited

U.S. PATENT DOCUMENTS

| | | | | |
|---|---|---|---|---|
| 4,760,718 | A * | 8/1988 | Muramatsu | B60B 1/06 70/18 |
| 5,475,993 | A * | 12/1995 | Kuo | E05B 67/003 411/504 |
| 5,913,906 | A | 6/1999 | Strocchi | |
| 6,820,448 | B1 * | 11/2004 | Hsieh | E05B 67/003 70/18 |
| 7,712,339 | B2 | 5/2010 | Hentschel et al. | |
| 8,621,898 | B2 * | 1/2014 | Chen | E05B 67/003 70/18 |
| 8,881,559 | B1 * | 11/2014 | Chang | E05B 67/003 70/49 |
| 2017/0051537 | A1 * | 2/2017 | Wang | E05B 67/003 |

FOREIGN PATENT DOCUMENTS

| | | |
|---|---|---|
| JP | 8-128245 A | 5/1996 |
| JP | 2000-2031 A | 1/2000 |
| TW | M350495 | 2/2009 |

* cited by examiner

*Primary Examiner* — Lloyd A Gall
(74) *Attorney, Agent, or Firm* — Birch, Stewart, Kolasch & Birch, LLP

(57) ABSTRACT

A chain lock is provided. The chain lock includes a lock body and a linkage chain set. The lock body includes a lock core disposed in the lock body, a lock body side face, and a socket. The linkage chain set is formed via linking a plurality of linkage chains. Each linkage chain is formed via linking a plurality of link plates. One end of the linkage chain set is joined with the lock body, wherein the other end of the linkage chain set can be inserted into the socket and secured by the lock core. When the other end of the linkage chain set is not secured by the lock core, each linkage chain can be folded to make the link plates overlap with each other, wherein the folded linkage chains can lean against each other and are located beside the lock body side face.

10 Claims, 4 Drawing Sheets

CHAIN LOCK

BACKGROUND OF THE INVENTION

1. Field of the Invention

The present invention generally relates to a chain lock having a lock body and a linkage chain set. More particularly, the present invention relates to a chain lock having a linkage chain set folded beside the lock body to reduce the volume of the chain lock.

2. Description of the Prior Art

Regarding locks, a U.S. Pat. No. 7,712,339 disclosed a joint rod lock, which includes a lock body and a joint bar hoop formed via linking a plurality of bars, and which can be folded together to reduce the volume thereof when collected. A Taiwan patent No. M350495 also disclosed a similar lock.

Compared with the conventional U-shape padlocks having a bulky volume, the abovementioned linkage locks indeed have the advantage of size reduction while being collapsed for storage. However, the abovementioned prior arts still have room for improvement. For example, the appearance of the collapsed locks should be taken into consideration in design in addition to volume reduction.

SUMMARY OF THE INVENTION

An object of the present invention is to provide a chain lock.

The chain lock of the present invention includes a lock body and a linkage chain set. The lock body includes a lock core disposed in the lock body, a lock body side face, and a socket. The linkage chain set includes a first linkage chain and a second linkage chain. The first linkage chain is formed via linking a plurality of first link plates and has a first linkage chain first end and a first linkage chain second end. The first linkage chain first end is joined with the lock body. The second linkage chain is formed via linking a plurality of second link plates and has a second linkage chain first end and a second linkage chain second end. The second linkage chain first end is joined with the first linkage chain second end. The second linkage chain second end can be inserted into the socket and secured by the lock core. When the second linkage chain second end is not secured by the lock core, the first linkage chain can be folded to make the plurality of first link plates overlap with each other, the second linkage chain can be folded to make the plurality of second link plates overlap with each other, the folded first linkage chain and the folded second linkage chain can lean against each other and are located beside the lock body side face.

In one embodiment, the chain lock further includes a linkage chain connector, wherein the opposite ends of the linkage chain connector are respectively joined with the first linkage chain second end and the second linkage chain first end.

In one embodiment, when the first linkage chain first end is joined with one end of the lock body, the socket is disposed in the other end of the lock body and on the lock body side face.

In one embodiment, there is an axial distance between two ends of the lock body. The first link plate and the second link plate respectively have a first link plate width and a second link plate width. The axial distance equals to the sum of the first link plate width and the second link plate width.

In one embodiment, when the second linkage chain second end is not secured by the lock core and the first linkage chain and the second linkage chain lean against each other, the first link plates and the second link plates are respectively perpendicular to an axial line passing through the two ends of the lock body.

In one embodiment, the chain lock includes a lock body and a linkage chain set. The lock body includes a lock core disposed in the lock body, a lock body side face, and a socket. The linkage chain set is formed via linking a plurality of linkage chains. Each linkage chain is formed via linking a plurality of link plates. One end of the linkage chain set is joined with the lock body, wherein the other end of the linkage chain set can be inserted into the socket and secured by the lock core. When the other end of the linkage chain set is not secured by the lock core, each linkage chain can be folded to make the link plates overlap with each other, wherein the folded linkage chains can lean against each other and are located beside the lock body side face.

In one embodiment, the chain lock further comprises at least a linkage chain connector, wherein the plurality of linkage chains are linked via the linkage chain connector.

In one embodiment, the socket is disposed in a bottom face of the lock body, where one end of the linkage chain set is joined with the bottom face in a position other than the socket.

In one embodiment, there is an axial distance between two ends of the lock body, wherein the axial distance equals to the sum of the width of the link plate of each linkage chain.

In one embodiment, when the other end of the linkage chain set is not secured by the lock core and the adjacent linkage chains lean against each other, the link plates of each linkage chain are respectively perpendicular to an axial line passing through the two ends of the lock body.

Accordingly, the chain lock of the present invention can be folded together to reduce the volume thereof when collected.

It is to be understood that the above description and the embodiments below are merely illustrative and are not to be considered limitations to the scope of the invention.

DETAILED DESCRIPTION OF THE PREFERRED EMBODIMENT

Figure 1A:
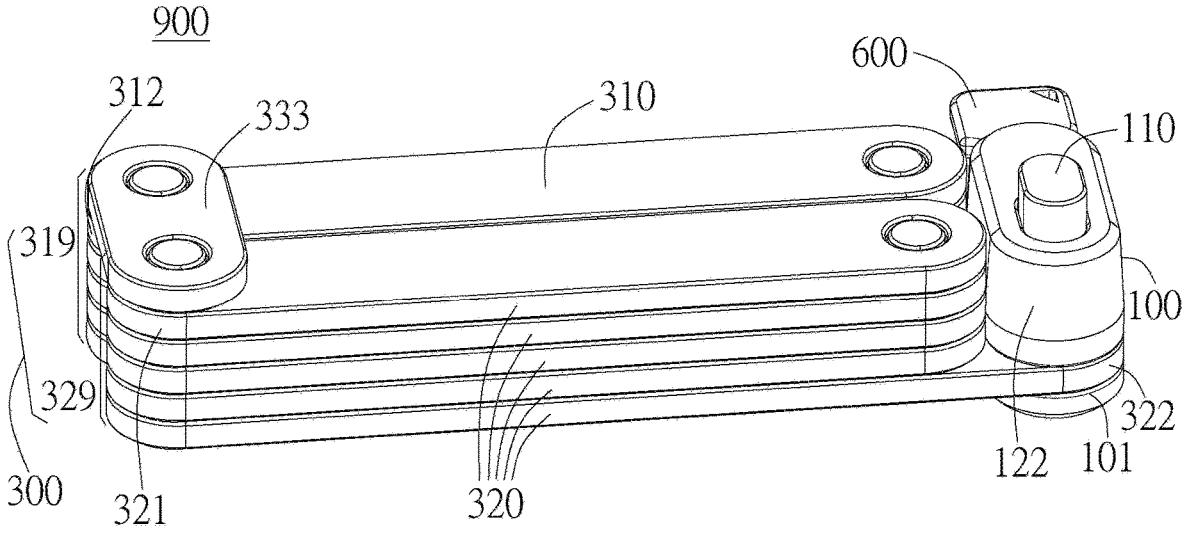
FIGS. 1A and 1B are schematic perspective views of the chain lock with the linkage chain folded beside the lock body according to one embodiment of the present invention.
Figure 1B:
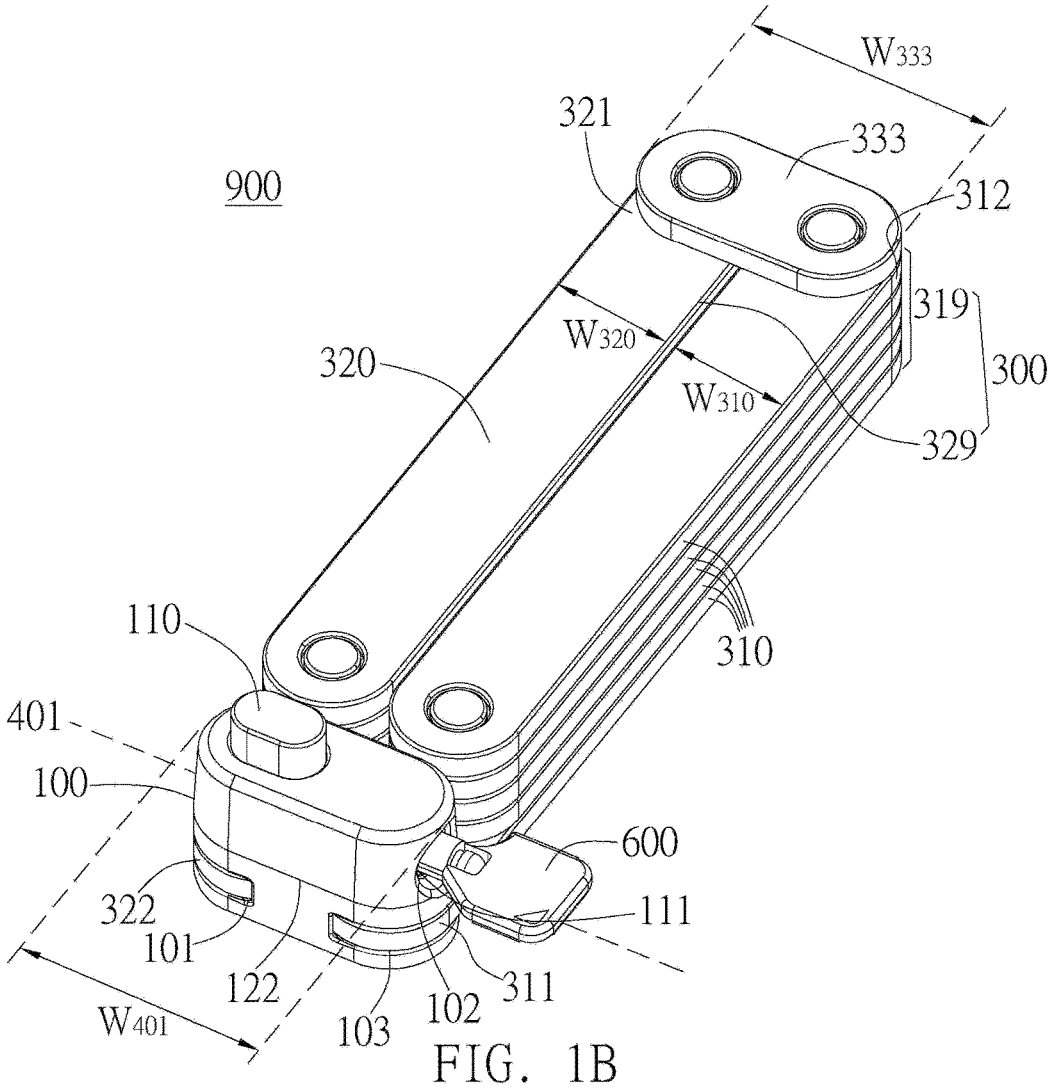

As shown in the embodiments in FIGS. 1A and 1B, the chain lock 900 of the present invention includes a lock body 100 and a linkage chain set 300. The lock body 100 includes a lock core 111 disposed therein, a lock body side face 122, and a socket 101. The linkage chain set 300 includes a first linkage chain 319 and a second linkage chain 329.

As shown in the embodiments in FIGS. 1A and 1B, the first linkage chain 319 is formed via linking a plurality of first link plates 310. Specifically, the plurality of first link plates 310 are pivotally linked with each other, wherein adjacent first link plates 310 can rotate with respect to the connected part. The first linkage chain 319 has a first linkage chain first end 311 and a first linkage chain second end 312 in the opposite two ends, wherein the first linkage chain first end 311 is joined with the lock body 100. As shown in the embodiment in FIG. 1B, a joining hole 103 is disposed on the lock body side face 122. The first linkage chain first end 311 can be inserted into the joining hole 103 and be pivotally joined with the lock body 100. Accordingly, the first link plate 310 joined with the lock body 100 can rotate with respect to the lock body 100. In different embodiment, a flange, instead the joining hole 103, is disposed on the lock body 100 for being pivotally joined with the first linkage chain first end 311. In another embodiment, the first linkage chain first end 311 is directly pivotally joined with the top face or the bottom face of the lock body 100.

From a different point of view, the first linkage chain first end 311 is joined with one end of the lock body 100. The socket 101 is disposed in the other end of the lock body 100 and is on the lock body side face 122. As shown in the embodiments in FIGS. 1A and 1B, the lock core 111 is a key lock core. A key hole 102 is disposed in the other end of the lock body 100 with respect to the socket 101 for a key 600 of the key lock core to be inserted into the same. The lock core 111 is not limited to a key lock core and can be other types. The key hole 102 can be disposed in a position other than the end of the lock core 111, e.g. the top face or the bottom face. On the other hand, an operating device 110 can be disposed on the top face of the lock body 100 for operating the lock core 111 to be locked or unlocked.

As shown in the embodiments in FIGS. 1A and 1B, the second linkage chain 329 is formed via linking a plurality of second link plates 320. Specifically, the plurality of second link plates 320 are pivotally linked with each other, wherein adjacent second link plates 320 can rotate with respect to the connected part. The second linkage chain 329 has a second linkage chain first end 321 and a second linkage chain second end 322 in the opposite two ends. The second linkage chain first end 321 is joined with the first linkage chain second end 312. The second linkage chain second end 322 can be inserted into the socket 101 and secured by the lock core 111.

As shown in the embodiments in FIGS. 1A and 1B, the chain lock further includes a linkage chain connector 333, wherein the opposite ends of the linkage chain connector 333 are respectively joined with the first linkage chain second end 312 and the second linkage chain first end 321. In other words, the first linkage chain 319 and the second linkage chain 329 are joined with each other through the joining of the first linkage chain second end 312 and the second linkage chain first end 321 with the linkage chain connector 333. In different embodiment, however, the first linkage chain second end 312 can join directly with the second linkage chain first end 321 without the linkage chain connector 333.

As shown in the embodiments in FIGS. 1A and 1B, when the second linkage chain second end 322 is not secured by the lock core 111, the first linkage chain 319 can be folded to make the plurality of first link plates 310 overlap with each other, the second linkage chain 329 can be folded to make the plurality of second link plates 320 overlap with each other, the folded first linkage chain 319 and the folded second linkage chain 329 can lean against each other and are located beside the lock body side face 122. From a different point of view, when the second linkage chain second end 322 is not secured and the first linkage chain 319 and the second linkage chain 329 lean against each other, the first link plates 310 and the second link plates 320 are respectively perpendicular to an axial line 401 passing through the two ends of the lock body 100.

Accordingly, the chain lock 900 of the present invention can be folded together to reduce the volume thereof when collected. On the other hand, as shown in the embodiments in FIGS. 1A and 1B, Specifically, there is an axial distance $W_{401}$ between two ends of the lock body 100. The first link plate 310 and the second link plate 320 respectively have a first link plate width $W_{310}$ and a second link plate width $W_{320}$. The axial distance $W_{401}$ equals to the sum of the first link plate width $W_{310}$ and the second link plate width $W_{320}$. Moreover, the length of the linkage chain connector 333 also equals to the sum of the first link plate width $W_{310}$ and the second link plate width $W_{320}$. Accordingly, the chain lock 900 of the present invention can be folded as column shape when collected and hence more suitable to be put in long-shaped storage space such as bike bottle cages. More particularly, with appropriate design and manufacture, when the chain lock 900 of the present invention is collected, the width in the transverse direction (the cross-sectional direction of the linkage chain when the linkage chain set is folded) an the length in the longitudinal direction (the extending direction of the linkage chain when the linkage chain set is folded) are respectively about equal to the diameter and length of the bike bottle cages. Hence, the chain lock 900 of the present invention can be directly put in the bike bottle cage, wherein an extra shelf is not needed.

The operation of the chain lock 900 of the present invention is described below.

Figure 2A:
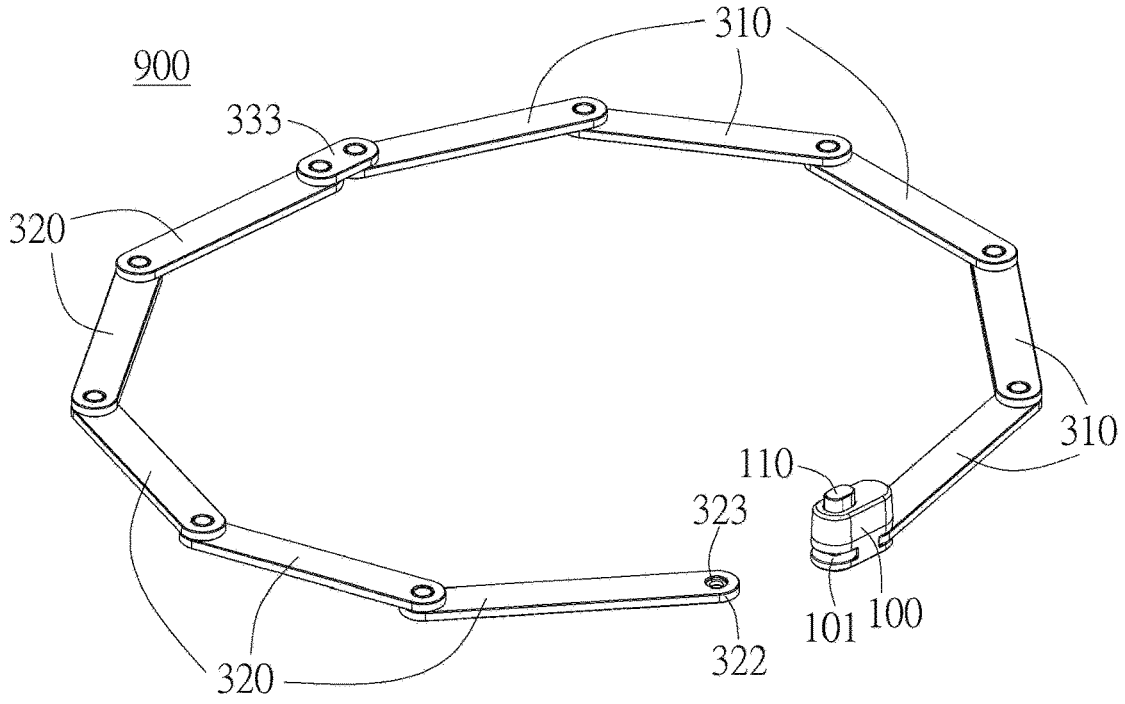
FIGS. 2A and 2B are schematic perspective views of the chain lock with the expanded linkage chain detached from the lock body according to one embodiment of the present invention.
Figure 2B:
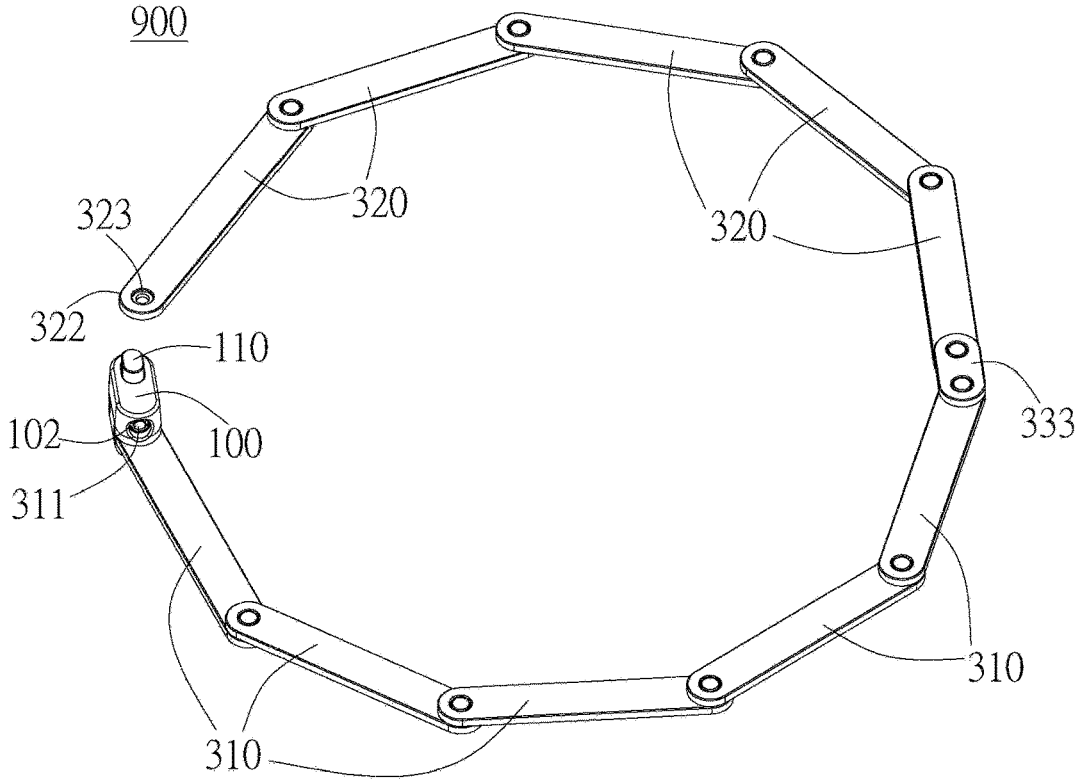
Figure 3A:
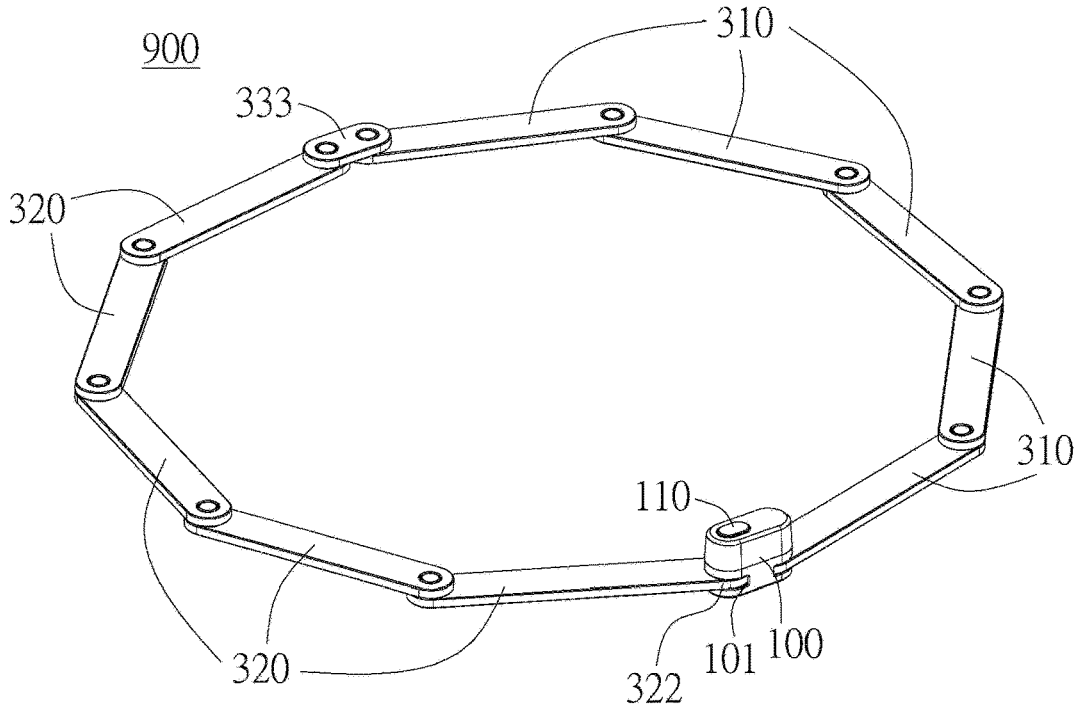
FIGS. 3A and 3B are schematic perspective views of the chain lock with the second linkage chain second end inserted into the socket according to one embodiment of the present invention.
Figure 3B:
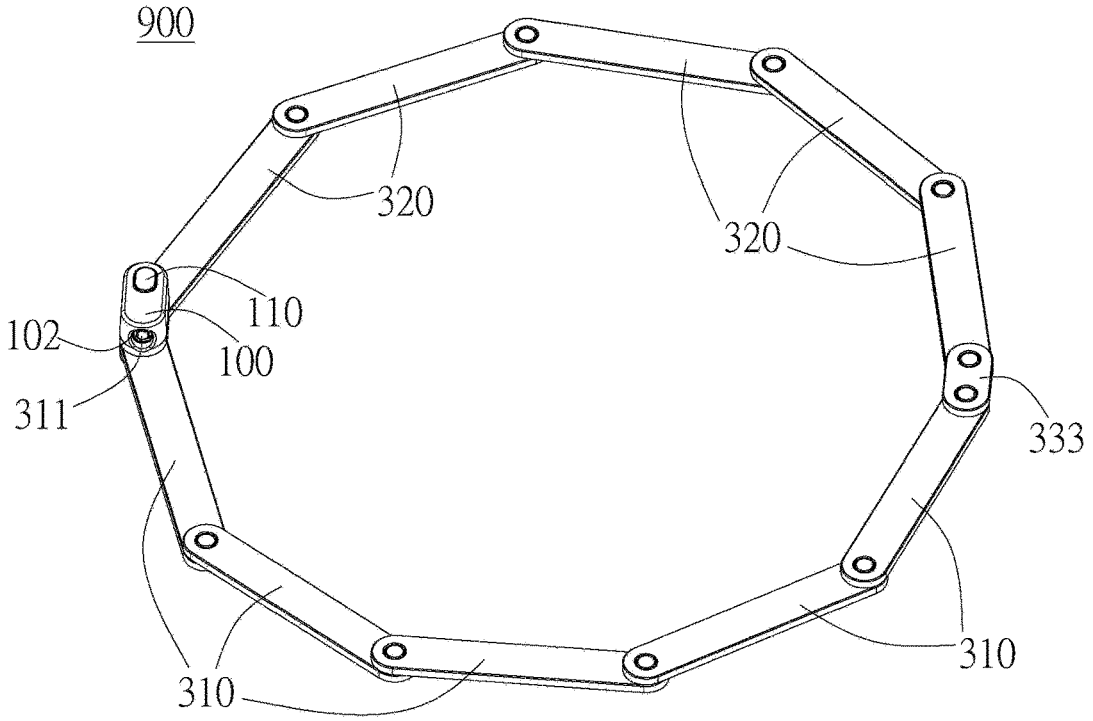

As shown in the embodiments in FIGS. 2A and 2B, the second linkage chain 320 and the first linkage chain 310 not directly joined with the lock body 100 can be pulled away from the lock body 100 by a user and be inserted into an object (e.g. the wheel frame of bikes). After that, as shown in the embodiments in FIGS. 3A and 3B, the second linkage chain second end 322 is inserted into the socket 101 and restricted from leaving the socket 101 by the lock core 111.

More particularly, a positioning hole 323 is disposed in the second linkage chain second end 322, wherein the lock core 111 has a latch. The latch is able to move in the lock body 100 when the lock core 111 is in an unlock-state, e.g. the lock core 111 is unlocked by a user with a key for a key lock or with a correct unlock number for a combination lock. The movement of the latch in the lock body 100 is restricted when the lock core 111 is in a lock-state. The above mentioned structure of lock core is well-known and no further description is provided here. When the second linkage chain second end 322 is inserted into the socket 101, it can be restricted from leaving the socket 101 by passing the latch of the lock core 111 through the positioning hole 323. In different embodiments, the second linkage chain second end 322 is not limited to has the positioning hole and can be a ring or a hook for being passed through by the latch. The user can unlock the lock core 111 and release the movement restriction of the latch. Hence, the latch is able to leave the second linkage chain second end 322 and the second linkage chain second end 322 is able to leave the socket 101.

As shown in the embodiments in FIGS. 1A to 3B, the linkage chain set 300 includes two linkage chains, i.e. the first linkage chain 319 and the second linkage chain 329. In different embodiments, however, the number of the linkage chain can be modified according to the manufacturing, design, and using requirements. Specifically, more linkage chains result in the increasing of the total length of the expanded linkage chain set for locking the object on a larger body, e.g. a pillar of a building.

Figure 4A:
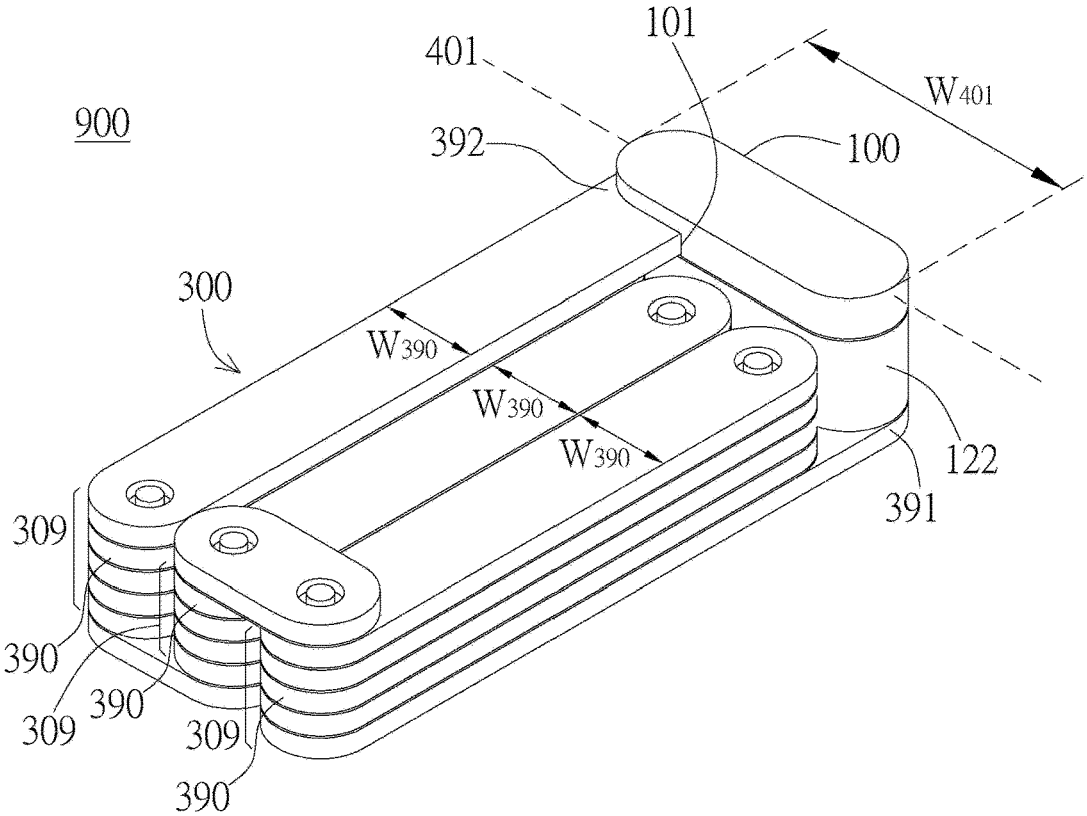
FIGS. 4A and 4B are schematic views of another embodiment of the present invention.
Figure 4B:
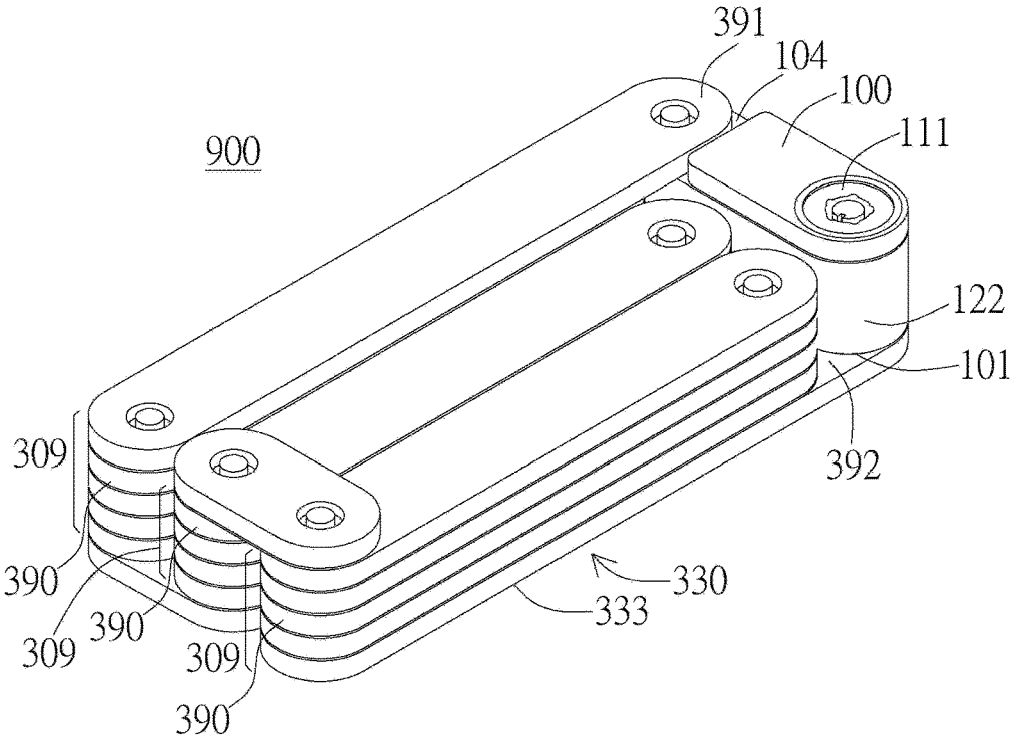

More particularly, as shown in the embodiments in FIGS. 4A and 4B, the chain lock 900 includes a lock body 100 and a linkage chain set 300. The lock body 100 includes a lock core 111, a lock body side face 122, and a socket 101. The linkage chain set 300 is formed via linking a plurality of linkage chains 309. Each linkage chain 309 is formed via linking a plurality of link plates 390. One end 391 of the linkage chain set 300 is joined with the lock body 100, wherein the other end 392 of the linkage chain set 300 can be inserted into the socket 101 and secured by the lock core 111. When the other end 392 of the linkage chain set 300 is not secured by the lock core 111, each linkage chain 309 can be folded to make the link plates 390 overlap with each other, wherein the folded linkage chains 309 can lean against each other and are located beside the lock body side face 122.

As shown in the embodiments in FIGS. 4A and 4B, the chain lock 900 further comprises at least a linkage chain connector 333, wherein the plurality of linkage chains 309 are linked via the linkage chain connector 333. In different embodiments, however, the plurality of linkage chains 309 are directly joined with each other.

As shown in the embodiments in FIGS. 4A and 4B, the socket 101 is disposed in a bottom face of the lock body 100, where one end 391 of the linkage chain set 300 is joined with the bottom face in a position other than the socket 101. More particularly, there is a dent 104 in the position other than the socket 101. The end 391 of the linkage chain set 300 is pivotally connected to the dent 104.

As shown in the embodiment in FIG. 4A, there is an axial distance $W_{401}$ between two ends of the lock body 100, wherein the axial distance $W_{401}$ equals to the sum of the width of the link plate of each linkage chain 309. In other words, the link plate 390 of each linkage chain 309 has respectively a link plate width $W_{390}$, wherein the axial distance $W_{401}$ equals to the sum of the link plate width $W_{390}$. Moreover, the length of the linkage chain connector 333 is preferably equal to the sum of the link plate width $W_{390}$ of the adjacent linkage chain. From a different point of view, when the other end 392 of the linkage chain set 300 is not secured by the lock core 111 and the adjacent linkage chains 309 lean against each other, the link plates 390 of each linkage chain 309 are respectively perpendicular to an axial line 401 passing through the two ends of the lock body 100.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A chain lock, comprising:

a lock body including a lock core disposed in the lock body, a lock body side face, and a socket; and a linkage chain set, including:

a first linkage chain formed via linking a plurality of first link plates and having a first linkage chain first end and a first linkage chain second end, wherein the first linkage chain first end is joined with the lock body; and a second linkage chain formed via linking a plurality of second link plates and having a second linkage chain first end and a second linkage chain second end, wherein the second linkage chain first end is joined with the first linkage chain second end, wherein the second linkage chain second end can be inserted into the socket and secured by the lock core;

wherein when the second linkage chain second end is not secured by the lock core, the first linkage chain can be folded to make the plurality of first link plates overlap with each other, the second linkage chain can be folded to make the plurality of second link plates overlap with each other, the folded first linkage chain and the folded second linkage chain can lean against each other and are located beside the lock body side face.

2. The chain lock of claim 1, further comprising a linkage chain connector, wherein the opposite ends of the linkage chain connector are respectively joined with the first linkage chain second end and the second linkage chain first end.

3. The chain lock of claim 1, wherein when the first linkage chain first end is joined with one end of the lock body, the socket is disposed in the other end of the lock body and on the lock body side face.

4. The chain lock of claim 1, wherein there is an axial distance between two ends of the lock body, wherein the first link plate and the second link plate respectively have a first link plate width and a second link plate width, wherein the axial distance equals to the sum of the first link plate width and the second link plate width.

5. The chain lock of claim 1, wherein when the second linkage chain second end is not secured by the lock core and the first linkage chain and the second linkage chain lean against each other, the first link plates and the second link plates are respectively perpendicular to an axial line passing through the two ends of the lock body.

6. A chain lock, comprising:

a lock body including a lock core disposed in the lock body, a lock body side face, and a socket; and a linkage chain set formed via linking a plurality of linkage chains, wherein each linkage chain is formed via linking a plurality of link plates, wherein one end of the linkage chain set is joined with the lock body, the other end of the linkage chain set can be inserted into the socket and secured by the lock core;

wherein when the other end of the linkage chain set is not secured by the lock core, each linkage chain can be folded to make the link plates overlap with each other, the folded linkage chains can lean against each other and are located beside the lock body side face.

7. The chain lock of claim 6, further comprising at least a linkage chain connector, wherein the plurality of linkage chains are linked via the linkage chain connector.

8. The chain lock of claim 6, wherein the socket is disposed in a bottom face of the lock body, where one end of the linkage chain set is joined with the bottom face in a position other than the socket.

9. The chain lock of claim 6, wherein there is an axial distance between two ends of the lock body, wherein the axial distance equals to the sum of the width of the link plate of each linkage chain.

10. The chain lock of claim 6, wherein when the other end of the linkage chain set is not secured by the lock core and the adjacent linkage chains lean against each other, the link plates of each linkage chain are respectively perpendicular to an axial line passing through the two ends of the lock body.

* * * * *